United States Patent [19]

Kidd

[11] Patent Number: 4,958,675

[45] Date of Patent: Sep. 25, 1990

[54] METHOD FOR CASTING METAL ALLOYS WITH LOW MELTING TEMPERATURES

[75] Inventor: Thomas F. Kidd, Candiac, Canada

[73] Assignee: Electrovert Ltd., Toronto, Canada

[21] Appl. No.: 268,492

[22] Filed: Nov. 8, 1988

[51] Int. Cl.[5] ..... B22D 17/00

[52] U.S. Cl. ..... 164/120; 164/316

[58] Field of Search ..... 164/113, 133, 304, 314, 164/316

[56] References Cited

U.S. PATENT DOCUMENTS

| | | | |
|---|---|---|---|
| 2,831,214 | 4/1958 | Eyles et al. | 164/314 |
| 3,209,419 | 10/1965 | Deguchi et al. | 164/316 |
| 3,495,652 | 2/1970 | Perrella | 164/316 |
| 3,548,921 | 12/1970 | Butterfield | 164/304 |
| 4,261,414 | 4/1981 | Frenette et al. | 164/316 |
| 4,676,296 | 6/1987 | Pascoe et al. | 164/303 |
| 4,690,198 | 9/1987 | Hardey et al. | 164/316 |

FOREIGN PATENT DOCUMENTS

| | | | |
|---|---|---|---|
| 218037 | 10/1957 | Australia . | |
| 1483620 | 7/1971 | Fed. Rep. of Germany | 164/316 |
| 2128425 | 1/1973 | Fed. Rep. of Germany | 164/113 |
| 530249 | 12/1972 | Switzerland . | |
| 1250476 | 10/1971 | United Kingdom . | |
| 1377628 | 12/1974 | United Kingdom . | |
| 1391785 | 4/1975 | United Kingdom . | |
| 2063127A | 6/1981 | United Kingdom . | |

*Primary Examiner*—Richard K. Seidel

*Assistant Examiner*—Edward A. Brown

*Attorney, Agent, or Firm*—Darby & Darby

[57] ABSTRACT

A metal casting process for producing melt-out metal cores and the like made of metal alloys with low melting temperatures achieves a casting with uniform density, high quality finish and a fine grain structure. The process and apparatus do not require the pre-pressurization of a charging cylinder and permit closed dies to be used. The apparatus comprises a molten metal alloy tank, a cylinder in the tank having at its base a connection to a passageway leading through the tank to a die located outside the tank. A valve is provided in the passageway, located in the tank having a first position where the passageway to the die is open and a second position where the passageway to the die is closed. In the second position, a valve port provides a connection from the cylinder to the molten metal alloy in the tank. A valve actuator moves the valve from the first to the second position, a piston within the cylinder and a power system raises the piston in the cylinder with the valve in the second position to fill the cylinder with molten metal alloy and lower the piston with the valve in the first position to inject molten metal into the die. In a preferred embodiment, a second valve is located outside the tank and in the passageway to the die. The second valve operates in conjunction with the first valve in the first position to allow the injection of molten metal alloy into the die.

3 Claims, 3 Drawing Sheets

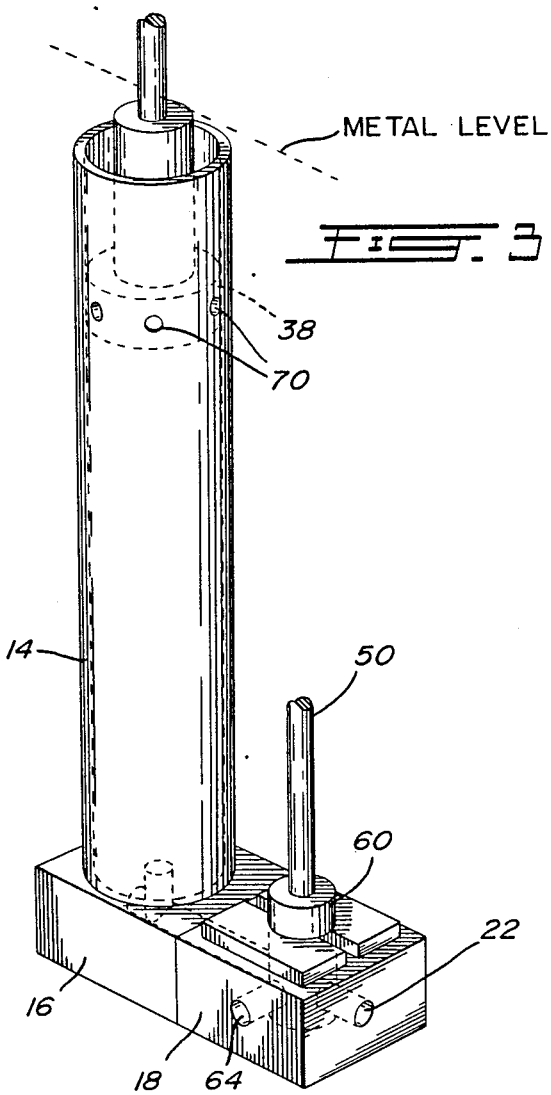
FIG. 3
FIG. 4
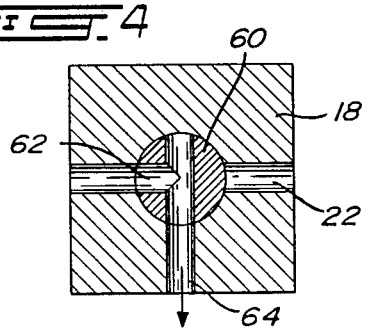
FIG. 5
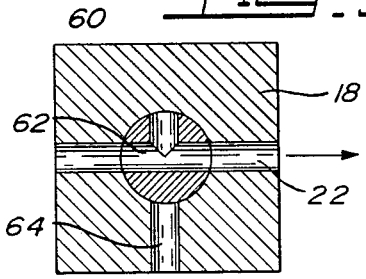

METHOD FOR CASTING METAL ALLOYS WITH LOW MELTING TEMPERATURES

The present invention relates to a metal casting process to produce melt-out metal cores for subsequent molding in components made of plastic material. More specifically, the present invention relates to a method and apparatus for casting metal alloys with low melting temperatures to achieve a product with uniform density and a fine grained structure.

Melt-out metal parts of complex shapes are made for use as cores in subsequently molded plastic components. Such cores are made of a low melting temperature alloy and are removed from the plastic components by melting the core and leaving the component. In another embodiment, metal alloys with low melting temperatures are used for encapsulating components such as turbine blades so they may be held for machining and other finishing steps. After use, the metal from the cores or encapsulations is remelted and re-used. One example of an apparatus for casting metal alloys with low melting temperatures is disclosed in U.S. Pat. No. 4,676,296. The apparatus requires pre-pressurization of the molten metal alloy in a cylinder before injection into a mold, and a stop limit switch to control the dispensed volume. The system disclosed in this patent generally requires the use of open dies, and thus it is necessary to inject a dispensed volume into a mold. In practice, this has proven a difficult process to operate commercially because pre-pressurization and a dispensed volume cannot be repeated consistently. Liquid metal alloy remaining in the cylinder and passages to the mould for long periods of time at injection temperatures, tends to crystallize and change in consistency.

In the apparatus depicted in U.S. Pat. No. 4,676,296, a cylinder is provided in a tank of liquid metal alloy with a passage from the bottom of the cylinder passing out through the tank and into a mold or die. A valve is provided in the passage to shut off the flow of molten metal alloy in between injection cycles. A piston moves up and down within the cylinder and the cylinder is filled by raising the piston up above a filler aperture in the top of the cylinder to allow liquid metal alloy to flow into the cylinder. Before commencing the injection step, the piston is moved downwards a predetermined amount so that the liquid metal alloy within the cylinder is pre-pressurized. After the pre-pressurization step, the valve in the passage to the die is opened to permit liquid metal alloy to be injected into the die.

One problem with this system is that it is difficult to drain any liquid metal alloy remaining in the cylinder without first of all completely draining the tank and then disassembling components. It must be appreciated that such a disassembly step has to be carried out with the components being hot, otherwise the metal alloy solidifies. Furthermore, over a period of time, metal alloy remaining within a cylinder, and retained at injection temperatures, which has not been selected for injection in multi cylinder machines, tends to grow crystals and suffers from element separation which can result in an increase in melt temperature.

The present invention provides a valve in the passage or transfer line from the bottom of the cylinder to the mold or die which is located in the metal alloy tank and has a port when the valve is in the closed position that closes the transfer line to the die, but opens up a connection from the cylinder to the liquid metal alloy in the tank. This permits molten metal alloy to be drawn into the cylinder through the port when the valve is in the closed position and the piston is raised. It also enables the piston within the cylinder to be reciprocated several times with the valve closed, thus permitting a change and recirculation of the liquid metal alloy within the cylinder with the liquid metal alloy in the tank.

With this additional port on the valve within the metal alloy tank, the present invention avoids the necessity of pre-pressurizing metal alloy in the cylinder prior to injection into a mold or die. It also permits the injection step to be carried out without having to have a stop limit switch or other control and permits use of a closed die rather than an open die, so that the die provides the volume control and no predetermined volume control is required. Furthermore, by maintaining pressure on the liquid metal alloy in the die during cooling, a casting with uniform density and a fine grain structure is achieved.

A further improvement in the present invention is that no extra pressure is required on the return stroke when the piston is being raised, as in the case when no port within the tank is provided, because on the return stroke, liquid metal alloy is pulled through the port to enter the cylinder. In the system disclosed in U.S. Pat. No. 4,676,296, an additional force to raise the piston is required to overcome the vacuum force and on the head of molten metal alloy, until the piston rises above the inlet aperture at the top of the cylinder.

It has been found that in addition to the process of the present invention being repeatable, the castings, being cores or other components made of metal alloys with low melting points, have an improved surface finish and a uniform dense fine grained structure.

The present invention provides in a method of producing a casting from a molten metal alloy having a melting point below about 350° C., including an injection cylinder having an injection piston therein, and means to raise and lower the piston of the cylinder, the injection cylinder having an injection passageway passing through a molten metal alloy tank to inject molten metal alloy from the tank into a die, the improvement comprising the steps of: closing the passageway from the injector cylinder to the die, filling the injection cylinder with molten metal alloy from the tank through a valve port in the injection passageway leading to the injection cylinder, by raising the piston in the cylinder, closing the valve port in the injection passageway and opening the passageway from the injection cylinder to the die, and injecting molten metal alloy into the die by lowering the piston in the cylinder.

The present invention also provides an apparatus for producing a casting from a molten metal alloy having a melting point below about 350° C., comprising a molten metal alloy tank containing molten metal alloy, a cylinder located in the tank having at its base a connection to a passageway leading through the tank to a die located outside the tank, a valve in the passageway located in the tank having a first position where the passageway to the die is open and a second position where the passageway to the die is closed, the connection from the cylinder leading via a valve port opening to molten metal alloy in the tank, valve operating means to transfer from the first position to the second position, a piston within the cylinder, and means to raise the piston in the cylinder with the valve in the second position to fill the cylinder with molten metal alloy and means to lower the piston in the cylinder with the valve in the first position to inject molten metal alloy into the die.

In drawings which illustrate embodiments of the invention:

FIG. 3 is an isometric view of a cylinder and valve for placing within a molten metal alloy tank;

FIG. 4 is a top cross sectional detailed view showing the rotary plug of the valve in the closed position;

FIG. 5 is a top detailed sectional view of the valve shown in FIG. 4 in the open position.

Low melting temperature metal alloys having a melting temperature in the range of about 35° to 350° C. are used for making castings for cores or encapsulation. Examples of these metal alloys are tin, antimony and lead alloys, and eutectic alloys of bismuth and tin.

Figure 1:
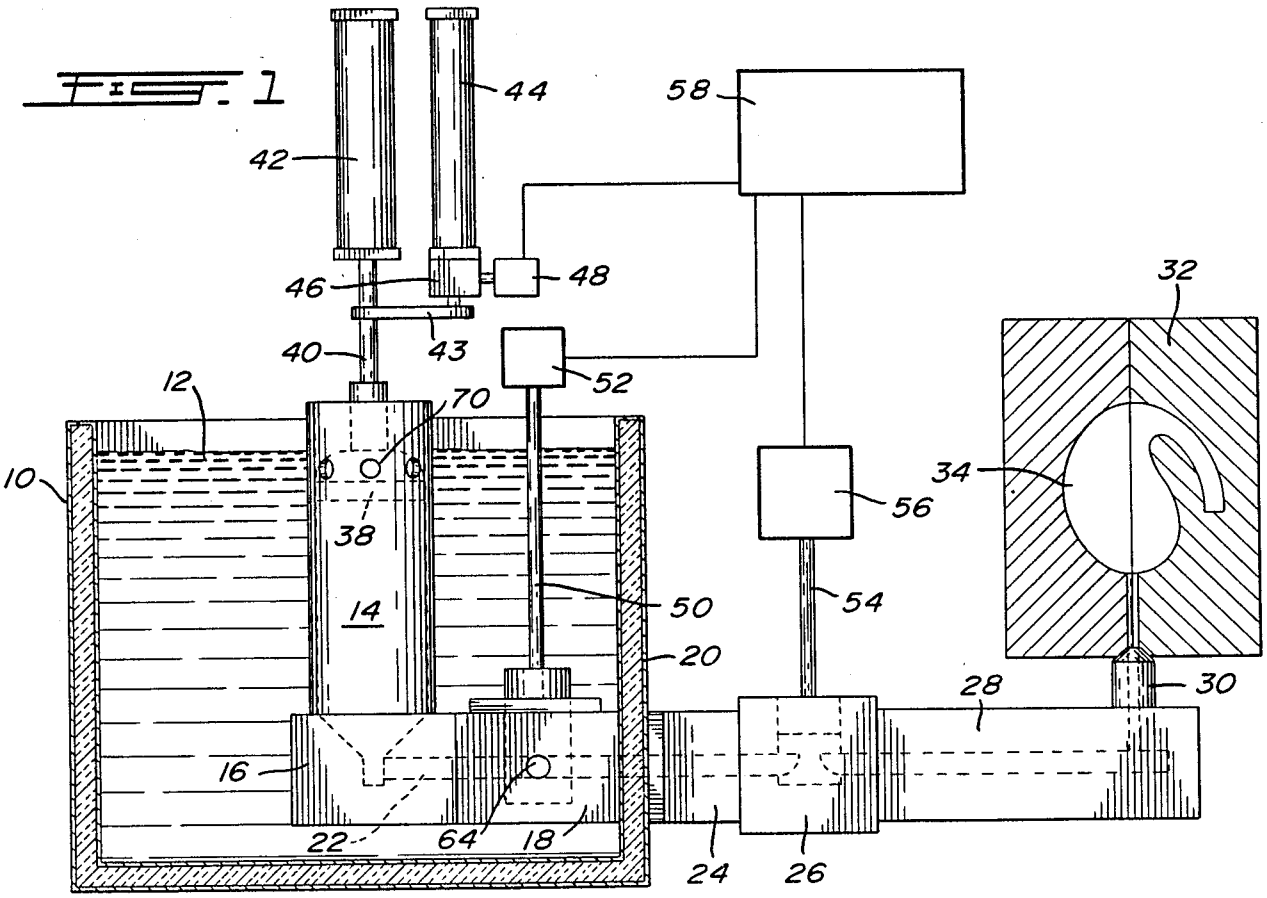
FIG. 1 is a schematic diagram depicting one embodiment of the apparatus for producing a casting from a molten metal alloy.

FIG. 1 illustrates a tank 10 filled with molten metal alloy 12 and having an injection cylinder 14 vertically positioned therein, mounted on an injection block 16. The injection block 16 is joined to a safety valve body 18 which in turn is attached to the wall 20 of the tank 10. A connecting passageway 22 extends from the injection cylinder block 16 where it is joined to the cylinder 14 through the safety valve body 18 and the wall 20 of the tank 10 into a standoff block 24 which is attached to a rotary single block valve body 26 in turn attached to a manifold 28. A nozzle 30 on the manifold 28 extends vertically upwards and joins a die 32 which is a closed die and may be removable from the nozzle 30 for separation and removal of the casting 34 within the die 32.

Figure 2:
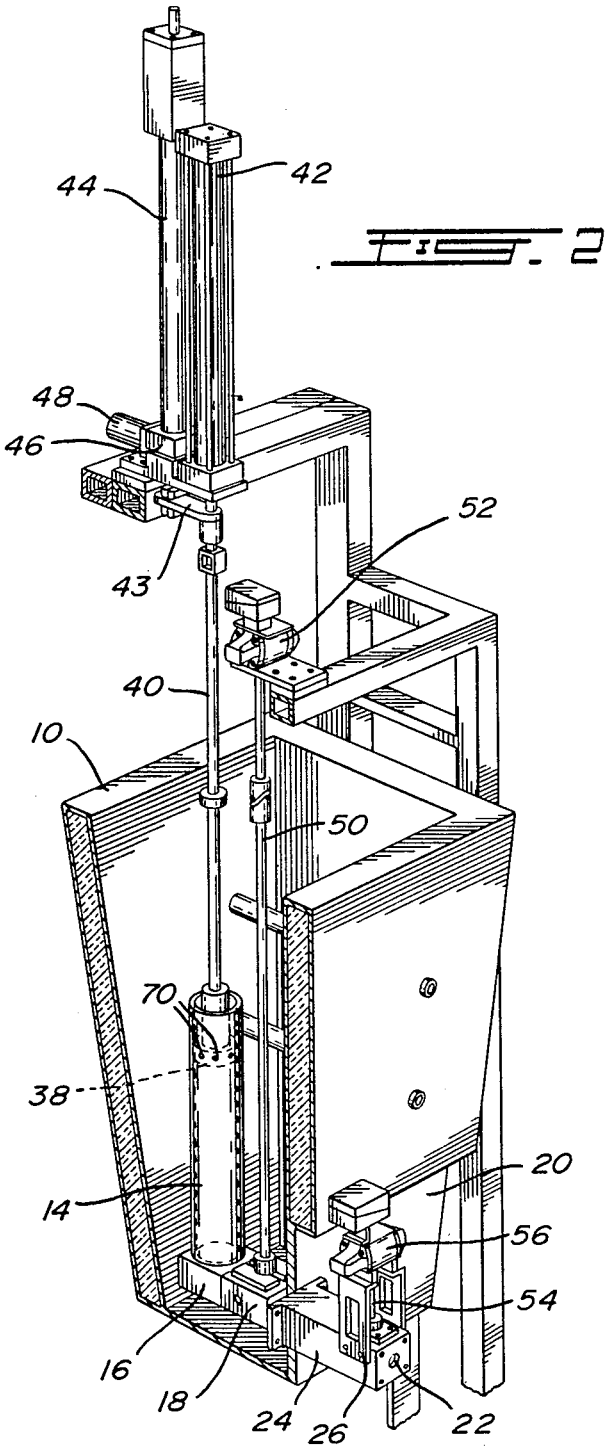
FIG. 2 is an isometric view, partially in section, of a molten metal alloy tank with a cylinder and valve within the tank.

As shown in FIG. 2, the injection cylinder 14 has an injection piston 38 on a shaft 40 which moves up and down within the cylinder 14. The piston 38 is powered by a pneumatic cylinder 42 which is double acting and has adjacent to it and joined by a bridge piece 43, a hydraulic cylinder 44 with a hydraulic valve 46 which has a stepper motor 48 to open and close the hydraulic valve 46 and thus affect speed control of the injecting piston 38. The air cylinder 42 is double acting, thus powers the piston 38 both upwards and downwards. The speed control is set by the stepper motor 48. The operation of the safety valve 18 is by a rotary shaft 50 extending up above the level of the molten metal alloy 12 in the tank 10 to a rotary actuator 52. Similarly, the rotary single lock valve 26 is activated by a shaft 54 connected to a rotary actuator 56. A micro-processor 58 as illustrated in FIG. 1 operates the pneumatic cylinder 42, controls the speed of the piston 38 in the cylinder 14 by the stepper motor 48 and drives the rotary actuators 52 and 56 to control the sequential steps of the casting process.

FIG. 3 illustrates the safety valve 18 and injection cylinder block 16. A plug 60 in the valve block 18 is rotated by the actuator shaft 50 to provide a three port two position valve. As shown in FIGS. 4 and 5, the plug 60 has a T-shaped port 62 which when in the closed position connects to a valve body port 64 which is within the tank 10, thus in the closed position as shown in FIG. 4, the cylinder 14 by means of the connecting passage 22 is connected to the valve body port 64 and when the piston 38 is raised in the cylinder 14, liquid metal alloy is pulled into the cylinder through the port 64 and the passageway 22. When the piston has reached its maximum height, which may be set by a limit switch (not shown), then the safety valve opens to the configuration shown in FIG. 5 and the passageway 22 is open from the cylinder 14 to the die 32. Thus as the piston 38 moves downwards, molten metal alloy flows through the passageway 22. Because the die 32 is a closed rather than an open die, when it fills up, there is no space for the molten metal alloy to go, and, therefore, it is maintained under pressure within the system by the piston 38 which is pushed down by the pneumatic cylinder 42. By maintaining the pressure on the piston 38 and thus within the die 32, the metal is allowed to cool and solidify under pressure ensuring that no voids remain in the casting 34.

Top ports 70 are provided at the top of the cylinder 14, thus if it is desired to drain the molten metal alloy from the tank 10, it is merely necessary to raise the piston 38 above the top ports 70, and open the valve body port 64 in the safety valve block 18. The liquid level then goes down in both the tank and the cylinder at the same time. Furthermore, the liquid metal alloy within the cylinder may be changed from time to time by merely reciprocating the piston 38 in the cylinder 14 with the valve port 64 open so that liquid metal alloy flows in and out as the piston 38 reciprocates.

There is no pressure in the injection cylinder prior to the injection cycle and when the safety valve 18 opens and the rotary single lock valve 26 opens, the liquid metal alloy flows into the mold controlled by the speed of the piston 70 which in turn is controlled by the stepper motor 48 to the valve 46 in the hydraulic cylinder 44. The mold or die 32 is closed and there is no pressure within the mold during the injection cycle. When the mold is completely full, pressure builds up and the liquid metal is held under pressure during solidification as the piston 38 is pushed downwards in the cylinder 14. The lock valve 26 closes and the safety valve 18 closes. The injection piston 38 is then raised up in the cylinder 14 allowing re-filling of the injection cylinder 14 with molten metal alloy through the port 64 in the safety valve block 18. The re-filling of the cylinder 14 occurs partly by gravity from the weight of liquid metal alloy in the tank 10 and partly by a vacuum occurring by raising the piston 38 in the cylinder 14.

The safety valve 18 shown herein incorporates a rotating plug 60 within a cylindrical aperture of the safety valve body 18. The lock valve 26 in one embodiment is of the type shown in our co-pending application, Ser. No. 268,553 filed Nov. 8, 1988. The lock valve described in this application provides a high temperature plastic rotating member having a flat surface that rotates on a polished flat surface of a stationary disc. The safety valve 18 may be a similar type of valve as that shown in my co-pending application for a lock valve with an additional port provided so that when the valve is in the closed position, a port in the side wall connects the passageway 22 leading to the cylinder 14 to the liquid metal alloy in the tank 10.

Liquid metal flow rates delivering metal alloy to a die vary from about 0.1 to 1 Kg/sec. The tank 10 maintains the liquid metal alloy therein at the desired temperature, and heaters may be provided in the passageway and lock valve outside the tank as well as in the die to ensure the metal alloys are kept above the melting temperature and flow easily into the dies.

Various changes may be made to the embodiments described herein without departing from the scope of the present invention which is limited only by the following claims. Whereas one cylinder 14 is shown within the tank, several cylinders each having their own passageway to separate dies may be used.

The embodiment of the invention in which an exclusive property or privilege is claimed are defined as follows:

1. In a method of producing a casting from a molten metal alloy having a melting point below about 350° C., including an injection cylinder having an injection piston therein, and means to raise and lower the piston in the cylinder, the injection cylinder having an injection passageway containing molten metal alloy, passing through a molten metal alloy tank to inject molten metal alloy from the tank into a die, the improvement comprising the steps of:

closing the passageway from the injection cylinder to the die;

filling the injection cylinder with molten metal alloy from the tank through a valve port located in the injection passageway at an elevation lower than the cylinder, by raising the piston in the cylinder;

closing the valve port in the injection passageway and opening the passageway from the injection cylinder to the die;

lowering the piston in the cylinder after the passageway is open so no prepressurization occurs in the cylinder or passageway prior to injection, the piston being lowered at a controlled rate so that substantially no pressure occurs in the die during injection, and applying pressure to the piston after the injection step to pressurize the molten metal alloy in the die during solidification of the casting.

2. The method of producing a casting according to claim 1 wherein the cylinder is placed within the molten metal tank, and filling of the injection cylinder is assisted by gravity when the valve port is open and the injection piston raised.

3. The method of producing a casting according to claim 1 including the addition of a rotary lock valve in the passageway outside the molten metal alloy tank adjacent the die, and wherein the rotary lock valve is closed during the filling step.

* * * * *